US006000639A

United States Patent [19]

Ganguli

[11] Patent Number: 6,000,639

[45] Date of Patent: Dec. 14, 1999

[54] TREATING MUNICIPAL SOLID WASTE FOR PRODUCING HYDROCARBON FUEL PRODUCTS

[75] Inventor: Partha S. Ganguli, Princeton, N.J.

[73] Assignee: Hydrocarbon Technologies, Inc., Lawrenceville, N.J.

[21] Appl. No.: 09/099,981

[22] Filed: Jun. 19, 1998

[51] Int. Cl.[6] ..... B02C 19/12

[52] U.S. Cl. ..... 241/17; 241/20; 241/21; 241/DIG. 38

[58] Field of Search ..... 241/17, 20, 21, 241/DIG. 38

[56] References Cited

U.S. PATENT DOCUMENTS

| | | | |
|---|---|---|---|
| 3,668,077 | 6/1972 | Ban | 201/29 |
| 3,830,636 | 8/1974 | Marsh | 44/1 D |
| 4,113,185 | 9/1978 | Marsh et al. | 241/21 |
| 4,624,417 | 11/1986 | Gangi | 241/17 |
| 5,387,267 | 2/1995 | Warf et al. | 44/589 |
| 5,649,785 | 7/1997 | Djerf et al. | 405/128 |

FOREIGN PATENT DOCUMENTS 2518121 11/1976 Germany .

*Primary Examiner*—Mark Rosenbaum
*Assistant Examiner*—D L Cooke
*Attorney, Agent, or Firm*—Fred A. Wilson

[57] ABSTRACT

Municipal solid waste (MSW) material is sized to provide a particulate material which is density separated into organic and inorganic portions using a suitable polar acidic organic liquid medium. The organic-MSW portion is digested in the polar acidic organic medium such as phenol at conditions of 500–850° F. temperature, 300–2000 psig pressure and 5–100 minutes residence time. The digested organic material is then fractionated to produce gas, a light liquid boiling below about 170° C., the polar acidic organic liquid medium such as phenol, boiling between 170 and 220° C., and a liquid slurry boiling above about 220° C. and including a powder material melting above about 400° C. The recovered acidic organic liquid fraction is preferably recycled back to the density separation and/or digesting steps for further use in the process. The liquid slurry fraction product having heating value of 9,000–16,000 Btu/lb. can be utilized as a clean fuel for combustion such as in steam boilers, or it can be catalytically hydrogenated for producing lower boiling hydrocarbon liquid fuels.

12 Claims, 1 Drawing Sheet

TREATING MUNICIPAL SOLID WASTE FOR PRODUCING HYDROCARBON FUEL PRODUCTS

BACKGROUND OF INVENTION

This invention pertains to treating municipal solid waste (MSW) and producing clean hydrocarbon liquid fuel products. It pertains particularly to processing sized particulate municipal solid waste materials by density separation in a suitable liquid medium into organic and inorganic portions, digestion of the organic portion, and fractionation of the digested organic material to produce clean hydrocarbon liquid and slurry fuel products having high heating values.

Great quantities of municipal solid waste (MSW) materials are generated and collected regularly in both rural and urban areas of the United States and other developed countries, and require suitable disposal methods, such as by incineration or by being placed in landfills. However, such disposal methods are becoming increasingly expensive and/or environmentally undesirable. Processing of municipal solid waste (MSW) materials to produce solid fuel products suitable for combustion in steam boilers of electric power plants is known, and some such processing plants are in use. However, such solid fuels have serious disadvantages including undesirably high moisture content, high ash contents and low heating value. Other processes for utilizing carbonaceous waste materials as a water slurry to produce gaseous or slurry fuels are disclosed by U.S. Pat. Nos. 5,485,728 and 5,685,153 to Dickinson. Because of the growing economic and environmental needs to recycle and reuse increasing amounts of municipal solid waste (MSW) material more efficiently, improvements and innovations in such waste treatment processes are needed and have been sought.

SUMMARY OF INVENTION

This invention provides an improved process for treating and converting sized particulate municipal solid waste (MSW) materials by density separation in a suitable liquid medium to provide organic and inorganic portions, followed by digestion of the organic portion and fractionation of the digested material, and producing clean hydrocarbon slurry fuel products having desirable relatively high heating value and low oxygen, nitrogen, sulfur and ash contents. The municipal solid waste materials for which this invention is useful include both (a) organic material such as agricultural and forestry wastes, foods, paper, plastics and wood residues and (b) inorganic materials such as concrete pieces, bricks and other fired clays, glass, metals, stones, etc. For best utility of this treating process, the weight percentage of the organic portion of the municipal solid waste (MSW) feed material should be at least about 30 wt % of the total waste material, and preferably should be 40–80 wt. % of the municipal solid waste feed material.

The process steps according to the invention include first sizing the MSW feed material containing both organic and inorganic portions by crushing, shredding and screening steps to provide particulates having desired size smaller than about 1.0 inch. The resulting sized MSW particulate material is next density separated in a suitable liquid medium having specific gravity in the range of 0.9–1.5 and at 15–90° C. temperature for separating out the lower density organic material portion from the remaining higher density inorganic material by utilizing a float and sink action for the particulate material in the liquid medium. Liquid mediums which are suitable for such density separation for the sized MSW materials broadly include polar organic compounds, and preferably include acidic organic compounds which are liquid at atmospheric pressure and within the useful temperature range of 15–90° C. Such liquids mediums include various organic acids and phenols and mixtures thereof having a specific gravity within the range of about 0.9 and 1.5, and preferably between 1.0 and 1.4. Because most of the sized organic-MSW particulate materials have specific gravities less than about 0.9 and will float in the selected liquid medium, and the inorganic particulate materials have specific gravities greater than about 1.5 and will sink, such density separations of the MSW particulate material in the liquid medium into organic and inorganic portions is effective.

Polar organic liquids and preferably acidic polar organic liquids having specific gravity and melting temperatures which are suitable for such density separations of the sized MSW particulates in this process include but are not limited to the following liquids:

| Liquid Medium | Sp. Gravity | Melting Temperature, °C. |
|---|---|---|
| Acetic Acid | 1.05 | 16.6° |
| Cresol | 1.03 | 30.9 |
| Simple Phenol | 1.05 | 43 |
| Substituted Phenols | 1.0–1.3 | 43–60 |
| Formic Acid | 1.22 | 8.6 |

Preferred liquid mediums based on their desirable properties and reasonable cost are cresol, phenol and substituted phenols and mixtures thereof. Use of water as a density separation liquid medium is avoided, because the final slurry hydrocarbon product from this process is intended to be used as a fuel for efficient combustion, and any appreciable water content would detract from the fuel value of the product.

From the density separation step, the resulting organic-MSW portion is next chemically digested in an acidic organic medium at conditions sufficiently severe to produce a suitably digested effluent material. Suitable digestion conditions are within the ranges 500–850° F. (260–455° C.) temperature and 300–2000 psig pressure for 5–100 minutes residence time depending upon the chemical composition of the sized particulate feed material, and the liquid medium, and the digestion temperature. The principal chemical reactions which occur in the digestion step include molecular decomposition to form smaller molecules, decarbonxyation, and mild acid hydrolysis. The digestion step is preferably continuous using the same polar acidic organic liquid medium as for the density separation step. Because of the acidic organic properties of the liquid medium, such as acetic acid and phenol used in the organic-MSW digestion step, hydrolysis of cellulose and lignin occur in the organic-MSW digestion step at the increased temperature and pressure conditions. Lignin as the protective layer for cellulose is the most difficult to dissolve, but because lignin is a polyphenolate it can be dissolved in the organic liquid medium. The digested organic heavy slurry material will have a desirably reduced oxygen content of 14.5–17 wt. %.

The digested organic effluent material is next fractionated at near atmospheric pressure so as to produce a gaseous fraction and a light hydrocarbon liquid fraction, substantially recover the acidic organic liquid fraction such as phenol which is suitable for recycle and reuse in the process, and also produce a unique heavy hydrocarbon liquid slurry fraction material product which is usually solid at room temperature. The gaseous fraction is mainly CO, $CO_2$ and $C_1$–$C_3$ hydrocarbons and the light liquid fractions has relatively high oxygen contents of 25–30 wt. %. The unique hydrocarbon slurry product has relatively high heating value of at least about 9,000 Btu/lb. and preferably 10,000–16,000 Btu/lb. based on the organic-MSW portion composition and digestion conditions, and is useful as a clean fuel for combustion in steam boilers in electric power plants. Alternatively, the unique heavy hydrocarbon slurry product can be used as a clean hydrocarbon feedstock suitable for further catalytic hydrogenation and hydroconversion to produce low boiling high value hydrocarbon liquid fuels. Typical chemical analysis by weight for the unique hydrocarbon liquid slurry product of this invention is as follows:

| | |
|---|---|
| Carbon | 75–79 |
| Hydrogen | 6–7.5 |
| Oxygen | 14.5–17 |
| Sulfur | 0.2–0.5 |
| Nitrogen | 0.01–0.05 |
| Ash | 0.01–0.1 |

From the above description, it is apparent that the process of this invention advantageously treats collected and sized municipal solid waste (MSW) materials to effectively separate out an organic portion by a density separation step in a selected liquid medium, and then converts the organic-MSW portion by chemical digestion reactions in the same or a similar liquid medium into useful fuel products, including a clean liquid slurry product having unique characteristics as a fuel and an attractive higher heating value of 9,000–16,000 Btu/pound. The unique hydrocarbon liquid slurry product can also be used as a feedstock either alone or may be combined with other available fossil fuel resources such as heavy oils and/or coal to produce low-boiling hydrocarbon liquid products, as is described in co-pending patent application entitled "Catalytic Hydrogenation of Digested Organic-MSW Material", filed Jun. 19, 1998, Serial No. 09/099,982.

BRIEF DESCRIPTION OF DRAWINGS

This invention will now be described further with reference to the following drawings, in which.

DESCRIPTION OF INVENTION

Figures 1, 2:
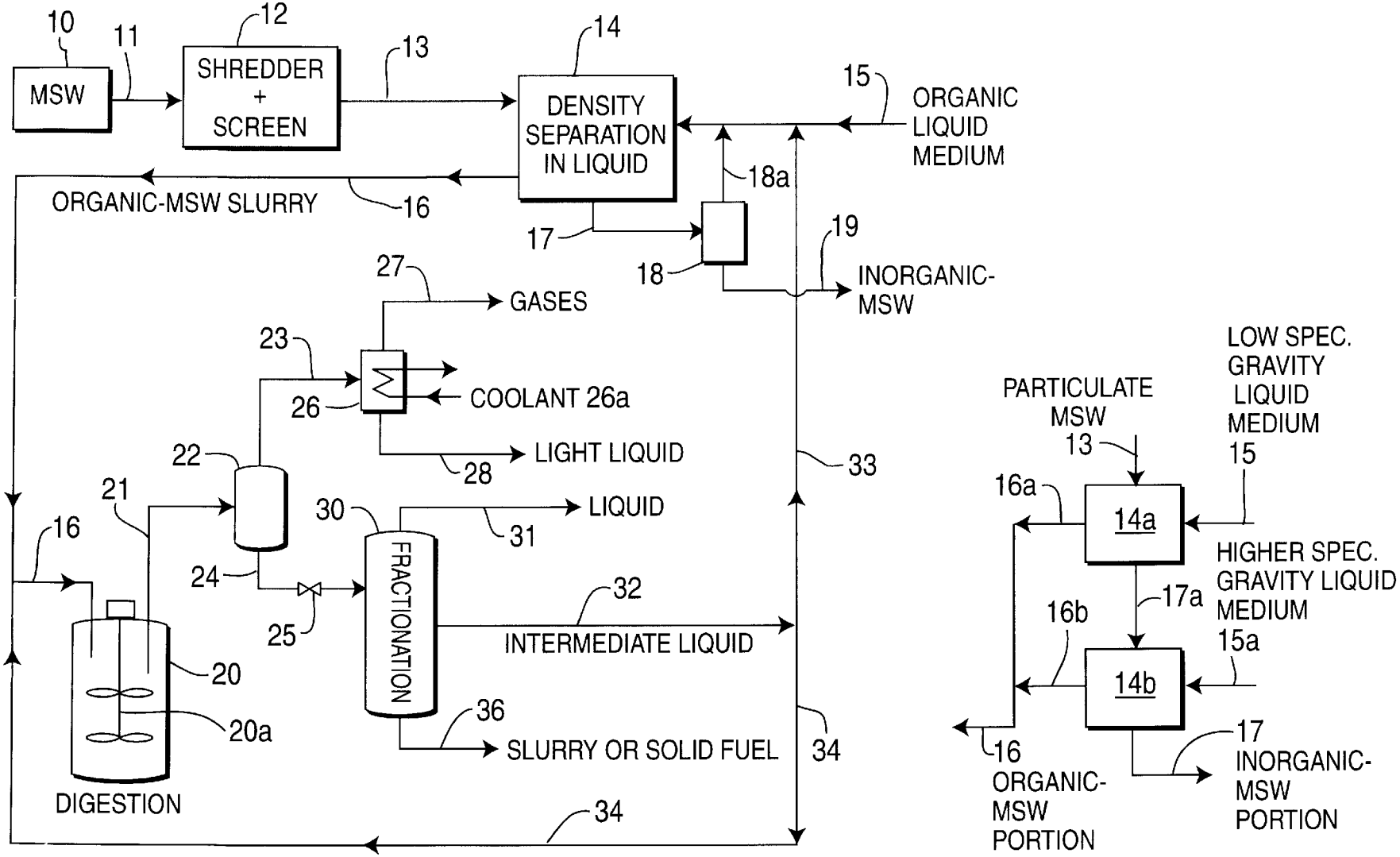
FIG. 1 is a schematic process flowsheet showing the principal steps utilized in treating and converting municipal solid waste (MSW) materials to produce clean hydrocarbon gas and liquid products according to the invention.
FIG. 2 shows an alternative process step utilizing two stage density separation of sized particulate MSW feed material to provide organic and inorganic portions as utilized in the invention.

As is depicted in the FIG. 1 flowsheet, bulk municipal solid waste (MSW) material is collected and provided at 10, and contains organic and inorganic material portions having typical weight percentage composition as follows:

| Organic Material, wt. % | |
|---|---|
| Food Wastes | 8–9 |
| Plant Wastes | 11–16 |
| Papers | 30–33 |
| Plastics | 11–12 |
| | 60–70 |

-continued

| Inorganic Material, wt. % | |
|---|---|
| Glass | 6–9 |
| Metals | 8–10 |
| Clays, Sand, Stones, etc. | 16–21 |
| | 30–40 |

The bulk MSW feed material provided at 10 is transferred at 11 by suitable means, such as by conveyor belt, to three successive mechanical processing steps provided at unit 12. These steps include a crusher or flail mill for initial size reduction, a trommel screen for partial removal of large size inorganic materials, and a flail mill or shredder for achieving desired size reduction in order to produce a substantially uniform particulate waste material having particle size smaller than about 1.0 inch, and preferably 0.05–1.0 inch size range.

These sized MSW particulates including both organic and inorganic portions are passed at 13 by suitable means such as a conveyor belt to a density separation step at 14, in which the sized particulates are density separated according to their specific gravities by immersion in a polar acidic organic liquid medium such as phenol provided at 15. The liquid medium has a specific gravity preferably in the range of 1.0–1.4 and is liquid in a temperature range of 15–90° C. depending upon the organic liquid medium being used. In the density separation step 14, the particulate material is separated in the liquid medium to provide an organic float portion removed at 16 and an inorganic sink portion withdrawn at 17, with each portion being a liquid-solid slurry. Useful density separation conditions at step 14 are 15–90° C. temperature and ambient pressure for 2–60 minutes residence time, with conditions of 20–80° C. temperature and 10–30 minutes residence time usually being preferred, depending on the specific gravity within the range of 0.9–1.5 and viscosity of the liquid medium.

If the feed rate for the particulate sized MSW material at 13 is intermittent or greatly variable, the density separation step at 14 can be provided by a batch type instead of a continuous type operation. Also if desired for improved removal of the organic material portion at step 14, two staged density separation steps at 14*a* and 14*b* can be provided in a series flow arrangement for density separating the particulates as shown in FIG. 2. The particulate MSW at 13 is fed to first separation stage 14*a* which uses a liquid medium 15 having a relativity low specific gravity to provide float portion 16*a* and sink portion 17*a*. The second separation stage 14*b* uses a liquid medium 15*a* having an increased specific gravity, so as to provide two organic-MSW float portions 16*a* and 16*b* which are combined as slurry stream 16, and provide a combined inorganic-MSW sink portion as slurry stream 17.

From the density separation step(s) provided at 14, the resulting organic-MSW float portion slurry material together with some of the liquid medium removed at 16 is passed to a digestion step at 20. The resulting heavier inorganic-MSW slurry sink portion material withdrawn at 17 is processed in a further liquid/solid separation step at 18 to recover the polar organic liquid medium such as phenol, prior to suitable disposal of the remaining inorganic waste material at 19 such as in a landfill. The liquid medium 18*a* recovered at separation step 18 from the heavy inorganic sink portion 19 is preferably recycled back to the density separation step 14 the polar oganic liquid medium stream 15.

In the digestion step at 20, the slurry stream of organic-MSW in the liquid medium at 16 is chemically digested in a pressurized stirred reactor provided with a rotary mixer 20*a* to facilitate the reactions therein. The reactor 20 is operated at broad conditions of 500–850° F. temperature and 300–2000 psig pressure for 5–100 minutes residence time sufficient to achieve a fully digested organic material containing desired gaseous and liquid fractions. Preferred digestion conditions are 650–780° F. temperature, 500–1600 psig pressure, and 10–50 minutes residence time. The principal digestion reactions in reactor 20 include molecular decomposition to form smaller molecules, decarbonyxlation, and mild acid hydrolysis.

From the digestion reactor 20, the effluent gases and liquid fractions are removed at 21 and phase separated in hot separator 22. From the separator 22, the gases portion is removed at 23, pressure reduced and passed to a condenser 26 which is cooled by a suitable liquid provided at 26*a* such as water. From the condenser 26, a gaseous stream 27 and a light liquid product stream 28 boiling below about 170° C. are removed separately. Also from the hot separator 22, the liquid slurry portion is withdrawn at 24, pressure-reduced at 25 to near atmospheric pressure, and fractionated in distillation column or tower 30 to produce desired gas and liquid product fractions and substantially recover the polar organic liquid medium such as phenol according to their selected boiling ranges.

From the fractionator tower 30, the gases and liquids normally boiling between about 170 –220° C. depending on the polar organic liquid medium provided are removed as stream 31. The gases and liquids removed at 31 have a relatively high oxygen content, and can be used as a supplement to natural gas feed for hydrogen production by steam reforming. A major intermediate liquid fraction boiling between about 170–220° C. is withdrawn at 32 and is mostly the recovered polar acidic liquid medium such as phenol and will have moderate oxygen content of 15–17%. This intermediate boiling range is selected so as to recover substantially the polar acidic liquid such as phenol for reuse in the process. A portion 33 of this intermediate liquid fraction at 32 is preferably recycled back to stream 15 for utilization as the liquid medium for the organic-MSW density separation step at 14. Another portion of the intermediate boiling liquid at 34 is preferably recycled back to the digestion step at 20 for use in digesting the organic-MSW material therein. Any remainder of this intermediate liquid fraction removed at 34 can also be used as a supplement to natural gas feed for hydrogen production by steam reforming. (not shown)

Also from the fractionation tower 30, the third heavy fraction stream withdrawn at 36 and normally boiling above about 220° C. is a unique carbonaceous slurry material containing some fraction of the organic-MSW feed, along with carbonized liquid plastic polymer, aromatics, ketones, and some oxygenated aliphatics from organic-MSW carbonized fraction. This heavy liquid slurry fraction 36 has high carbon content of 70–80%, and low oxygen content of 15–17%, and minimal nitrogen, sulfur and ash, and usually has a heating value of about 14,000–15,000 Btu/lb. which is comparable to clean bituminous coal. This carbonaceous slurry material 36 is usually solid at ambient temperature and is suitable for a combustion fuel such as for firing steam boilers. If desired, this material 36 can also be used as a feedstock for further catalytic hydroprocessing for producing lower-boiling hydrocarbon liquid fuels.

This invention will now be described further with reference to the following examples, which should not be construed as limiting the scope of the invention.

EXAMPLE 1

The technical feasibility of the basic MSW treatment process of this invention was demonstrated by experimental runs using simulated organic municipal solid waste (MSW) material samples treated in a 70 cc size batch microautoclave unit. The simulated organic-MSW feed material had the following basic composition by weight percent:

| | |
|---|---|
| Cloth | 1 |
| Plastics | 19 |
| Paper | 53 |
| Wood | 27 |
| | 100 |

This simulated organic-MSW material was digested in phenol solvent at 530° F. temperature and atmospheric pressure for 60 minutes to evaluate the resultant slurry material and determine its pumpability. The observed results were that about 70 wt. % of the simulated organic material after digestion in phenol solvent was soluble in tetrahydrofuran (THF) solvent. The resulting insoluble material was mostly small chunks of plastic and non-plastic powders. Because such plastic materials are mostly liquid at the 530° F. temperature of digestion, the resulting organic slurry material was considered to be pumpable at temperatures near its digestion temperature above about 500° F.

EXAMPLE 2

Digestion of another simulated organic-MSW material sample in phenol solvent was performed in a 1-liter size batch autoclave unit at 750° F. temperature and 1500 psig pressure for 30 minutes residence time to determine the resulting digested material product distribution. The percentage of moisture in the simulated organic-MSW affects the pressure needed for digestion, with higher % moisture requiring higher pressure to avoid evaporation. Following digestion the resulting product distribution by weight was as follows:

| | |
|---|---|
| Gas (mostly $CO_2$, CO and $C_1$–$C_6$ hydrocarbons), wt. % | 19.5 |
| Light liquid boiling below 170° C., (338° F.), wt. % | 18.0 |
| Heavy liquid boiling above 220° C., (428° F.), wt. % | 44.5 |
| Solid powders melting above 400° C., (752° F.), wt. % | 18.0 |
| | 100.0 |

These results show that oxygen containing compounds are concentrated in the gaseous and IBP-170° C. boiling liquid fractions. The liquid fraction boiling above 220° C. (428° F.) and the solid material can be a desirable fuel products having higher heating values. These two fractions combined have an oxygen content of only 15.5 wt. %, while the simulated organic-MSW feed material has an oxygen content of 46.7 wt. %. From the digestion step, simple phenolic liquid (normal booiling range 170–220° C.) was recovered, For this process, 10–15 wt. % process derived phenol needs to be recovered and can be recycled for reuse in the density separation and organic digestion steps. Alternatively, 10–15 wt. % low-cost waste-derived phenol from an external source could be added to the process.

These results indicate that digestion of high-oxygen content (46.7 wt. % $O_2$) organic-MSW feed material yields a slurry product having moderate-oxygen content (15.5 wt. % $O_2$) and high heating value suitable for combustion as a fuel, or suitable for further catalytic processing alone or for coprocessing with heavy oil or coal in a subsequent catalytic hydrogenation process to produce desirable hydrocarbon liquid products. These results are very significant and prove the basic technical feasibility of the process for treating MSW materials and producing a desirable unique hydrocarbon liquid product. Heating values of the organic-MSW fraction before digestion is only about 7,750 Btu/lb., but for the digested slurry product heating value is increased to about 14,410 Btu/lb. Thus, processing of organic-MSW material yields a hydrocarbon liquid slurry product which has significantly increased heating value of 10,000–16,000 Btu/lb. and is generally equivalent to or exceeds that for clean bituminous coal.

Although this invention has been disclosed broadly and also in terms of some preferred embodiments, it will be apparent that modifications and variations can be made to the basic process all within the scope as defined by the following claims.

I claim:

1. A process for treating municipal solid waste (MSW) material containing organic and inorganic portions, and producing clean hydrocarbon liquid products, the process comprising:

(a) providing a municipal solid waste (MSW) material including at least about 30 wt. % organic material portion, and sizing the solid waste material to produce particulates having size less than about 1.0 inch;

(b) density separating the sized particulates by float-sink action in a polar acidic organic liquid medium having specific gravity of 0.9–1.5 at 15–90° C. temperature, and removing a lower density organic material portion from a higher density inorganic material portion;

(c) digesting the organic material portion in a polar acidic organic liquid medium at conditions of 500–850° F. temperature, 300–2000 psig pressure and 5–100 minutes residence time and providing a digested organic effluent material; and (d) fractionating the digested organic effluent material and recovering a gaseous fraction, a light hydrocarbon liquid fraction, a polar acidic organic liquid fraction, and a heavy liquid slurry fuel product fraction having heating value at least about 9,000 Btu/lb.

2. The process of claim 1, wherein the sized solid waste particulates have size range of 0.05–1.0 inch.

3. The process of claim 1, wherein the density separation step occurs at 20–80° C. temperature and atmospheric pressure, and the polar acidic liquid medium has a specific gravity of 1.0–1.4.

4. The process of claim 1, wherein the digesting step for the organic material portion occurs at 650–780° F. temperature, 500–1600 psig pressure, and 10–50 minute residence time.

5. The process of claim 1, wherein the polar acidic organic liquid fraction is recovered from the fractionating step and recycled back to the density separation step for reuse in the process.

6. The process of claim 1, wherein the polar acidic organic liquid fraction is recovered from the fractionating step and recycled back to the digesting step for reuse in the process.

7. The process of claim 1, wherein the digested organic-MSW material is fractionated so as to provide a 16–22 wt. % gas fraction, a 16–22 wt. % light liquid normally boiling below 170° C. (338° F.); an acidic organic liquid fraction having boiling range of 170–220° C., 42–46 wt. % liquid fraction normally boiling above 220° C., and 16–20 wt. % powder melting above 400° C. (752° F.).

8. The process of claim 1, wherein the municipal solid waste (MSW) material feed contains at least 40 wt. % organic material.

9. The process of claim 1, wherein the acidic organic liquid medium is simple or substituted phenol having specific gravity of 1.0–1.3.

10. The process of claim 1, wherein the density separation step for the sized particulates includes two successive staged float-sink steps connected in series flow arrangement, with the second stage separation step utilizing an organic liquid medium having a specific gravity greater than that for the first stage separation step.

11. The process of claim 1, wherein the higher density inorganic material portion is withdrawn from the density separation step, and the polar acidic liquid medium portion is removed and recycled back to the density separation step.

12. A process for treating municipal solid waste (MSW) material containing organic and inorganic portions and producing clean hydrocarbon slurry products, the process comprising:

(a) providing a municipal solid waste (MSW) material including at least 40 wt. % organic material portion, sizing the solid waste material by shredding and screening to produce particulates having 0.05–1.0 inch size range;

(b) density separating the sized particulates by float-sink action using a phenolic liquid medium having specific gravity of 1.0–1.4 at 20–80° C. temperature, and removing a lower density organic material portion and withdrawing a higher density inorganic material portion;

(c) digesting the organic material portion in the phenolic liquid medium at conditions of 650–780° F. temperature, 500–1600 psig pressure and 10–50 minutes residence time and providing a digested organic effluent material;

(d) fractionating the digested effluent material and recovering a gaseous fraction, a light hydrocarbon liquid fraction, a phenolic liquid fraction, and a heavy slurry product fraction having heating value of 10,000–16,000 Btu/lb.; and (e) recycling said recovered phenolic liquid fraction back to the organic material portion digesting step for reuse in the process.

* * * * *